United States Patent [19]

Melega

[11] 4,177,980

[45] Dec. 11, 1979

[54] CLOTH-LAYING MACHINE

[75] Inventor: Albert Melega, Malverne, N.Y.

[73] Assignee: Cutting Room Appliances Corporation, Hicksville, N.Y.

[21] Appl. No.: 799,136

[22] Filed: May 23, 1977

[51] Int. Cl.[2] ..... B65H 29/46

[52] U.S. Cl. ..... 270/31

[58] Field of Search ..... 270/30–31

[56] References Cited

U.S. PATENT DOCUMENTS

| | | | |
|---|---|---|---|
| 1,131,647 | 3/1915 | Shapera | 270/31 |
| 2,148,375 | 2/1939 | Krassner | 270/31 |
| 2,488,345 | 11/1949 | Springer | 270/31 |
| 2,592,437 | 4/1952 | Pedus | 270/31 |
| 2,980,421 | 4/1961 | Deichmann | 270/31 |
| 3,479,023 | 11/1969 | Martin | 270/31 |

*Primary Examiner*—Edgar S. Burr

*Assistant Examiner*—A. Heinz

*Attorney, Agent, or Firm*—Joseph P. Gastel

[57] ABSTRACT

A cloth-laying machine including spaced dished side frame members connected by channel-shaped cross members and mounting four positively driven rubber-like wheels which are supported on a cloth-laying table, spaced spring-biased nonload bearing guide wheels mounted on one of the side frame members for engaging a guide track on the cloth-laying table, switches associated with the guide wheels for deactuating the machine driving motor in the event the guide wheels should leave the track, and a catcher blade actuating mechanism including rollers mounted in permanent elevated relationship to the top of a cloth-laying table and having a lost motion connection with the machine frame for actuating a catcher blade assembly. The machine also includes a supplementary brake system which is energized in the event that the primary braking system fails.

10 Claims, 39 Drawing Figures

TRAVEL
TRAVEL

CLOTH-LAYING MACHINE

BACKGROUND OF THE INVENTION

The present invention relates to an improved cloth-laying machine.

By way of background, cloth-laying machines are commonly used whenever layers of cloth have to be deposited on a table for subsequent cutting. In the past, cloth-laying machines had certain characteristics. The side frames of prior machines were generally fabricated from relatively heavy cast iron and/or aluminum. However, in spite of the relatively heavy side frame members, the machine was not sufficiently rigid in the desired directions. In this respect, the side frame members were connected by cross frame members in the nature of tubes, rods or threaded pipes. Such cross frame members permitted the side frame members to tilt from side to side during movement of the cloth-laying machine and also permitted the side frame members to experience relative fore and aft translational movement relative to each other, both of which caused the cloth spreading alignment to be irregular.

Another deficiency of prior cloth laying machines was that they were generally driven by means of toothed or grooved wheels which engaged a mating track suspended at the side of a cutting room table, generally in a cantilevered manner. This was objectionable because a large portion of the weight of the relatively heavy machine and its load of cloth was transferred to the track which was supported by the table in a weak manner. In addition, because of the rigid connection between the drive wheel and the frame of the machine, any undulations in the track were transmitted to the machine, to thereby cause it to move up and down unnecessarily. Conversely, any undulations in the surface of the cloth-laying table could cause the drive wheel to lose engagement with the track.

A further deficiency of prior machines was that the driving of an unequal number of wheels on each side caused an unequal torque or twist to be exerted on the machine, tending to cause it to travel in a nonlinear path. Additionally, if the braking of the carriage was only effected through an unequal number of wheels on the opposite sides of the machine, there could be skidding during braking.

Furthermore, prior machines, which traveled as fast as 300 feet per minute, relied only on a single braking system associated with less than four wheels. If this brake failed, the machine could roll off of the end of the table with its possible consequent destruction and injury to personnel. Furthermore, if the track wheel left the track, the machine would continue in operation in an unguided path, and it could roll off the table if not stopped in time.

In addition, in prior machines a tuck or folding blade and catcher blade assembly was used. The assembly created a fold at the end of machine travel, and the catcher blade held the folded end of the cloth in position. Various types of actuating mechanisms which were similar to the present construction were used in the past. However, the prior actuating mechanisms were not permanently elevated in their entirety above the top of the cloth-laying table and they did not have a lost motion connection associated therewith. The lack of the combination of these features caused prior constructions to be subject to jamming, breakage, or possibly even mismating with the associated part of the catcher with which it was to coact. In situations of this type, there could be severe damage to the machine and/or end catchers.

SUMMARY OF THE INVENTION

In order to overcome certain of the foregoing deficiencies, in accordance with one aspect of the present invention, the improved cloth-laying machine comprises first and second side frame members, and cross frame members for supporting said side frame members in spaced relationship while permitting said side frame members to move limited amounts in substantially vertical parallel planes without substantial translational front and rear movement relative to each other and without substanital tilting sideways in the direction transverse to the direction of longitudinal movement of the machine, whereby accurate cloth-laying is obtained.

In accordance with another aspect of the present invention, the improved cloth-laying machine comprises relatively lightweight first and second plate metal side frame members, and cross frame means joining said first and second plate metal side frame members, whereby the lower weight of the machine can compensate for the weight of heavier rolls of cloth.

In accordance with a still further aspect of the present invention, the improved cloth-laying machine comprises first and second side frame members, cross frame means for joining said first and second side frame members, a plurality of rubber-like wheels mounted on said first and second side frame members, and drive means including motor means for positively driving each of said rubber-like wheels, whereby good traction is provided for both normal movement and braking, without an attendant tendency for twisting in either case.

In accordance with yet another aspect of the present invention, the improved cloth-laying machine comprises a frame, load-bearing wheel means for supporting said frame on a cloth-laying table, motor means for driving said cloth-laying machine, guide wheel means mounted on said frame for engaging a track mounted relative to said table,, and spring-biasing means for biasing said guide wheel means toward said track, whereby the guide wheel means will maintain good contact with the track but will not carry the load of the machine. In addition, the guide wheels are integrated with the braking system so that the machine will automatically stop if the guide wheel means should leave the track.

In accordance with a still further aspect of the present invention, the improved cloth-laying machine comprises a frame, a plurality of wheel means for moving said frame on a cloth-laying table, motor means for driving said wheel means, brake means for stopping said machine, first means for actuating said brake means during normal operation, and second means for actuating said brake means in the event said first means fail to function, whereby safety in operation is assured.

The present invention also relates to a catcher assembly for use with a cloth-laying machine comprising first and second spaced standards, a catcher blade having first and second ends, first and second catcher arms mounting said first and second ends of said catcher blade, first and second catcher arm mounting means mounting said first and second catcher arms on said first and second standards for vertical movement, first and second cam means on said first and second catcher arms, respectively, and first and second cam actuating means carried by said cloth-laying machine in permanent elevated relationship to the top of a cloth-laying table for engaging said first and second cams, respectively, for raising said first catcher arms, respectively, when said machine is moving in a first direction to permit cloth to be deposited below said catcher blade, said first and second cam actuating means being mounted on said cloth-laying machine with a lost-motion connection to rise over said cams after said machine starts moving in a second direction which is opposite to said first direction.

The various aspects of the present invention will be more fully understood when the following portions of the specification are read in conjunction with the accompanying drawings wherein:

BRIEF DESCRIPTION OF THE DRAWINGS

FIGS. 4A and 4B are fragmentary perspective views of an edge control platform and its supporting channel, respectively, which can be adjusted in width;

DESCRIPTION OF THE PREFERRED EMBODIMENTS

Figure 1:
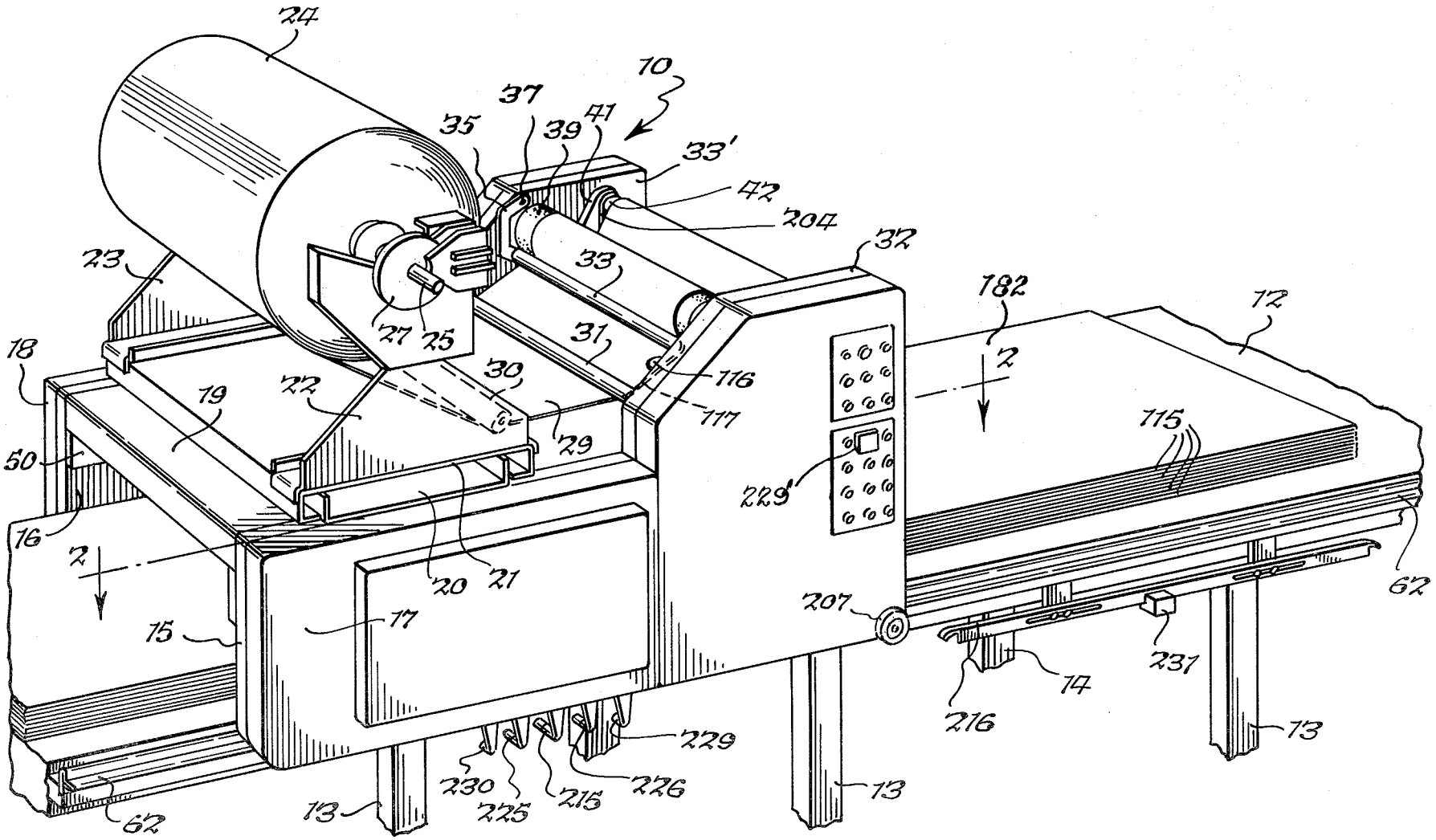
FIG. 1 is a fragmentary perspective view showing the improved cloth cutting machine of the present invention mounted on a cloth-laying table.

By way of broad introduction, the improved cloth-laying machine 10 of the present invention is shown in FIG. 1 mounted on a cloth-laying table 11 having an upper surface 12 which is supported on legs 13 at one side of the table and legs 14 at the opposite side of the table. The legs are located essentially along the edges of the table. Machine 10 includes first and second side frame members 15 and 16 which mount covers 17 and 18, respectively, to conceal the various parts mounted within the side frame members. The side frame members 15 and 16 are interconnected by channel-shaped cross frame members 19, as will be described in greater detail hereafter. Mounted across side frame members 15 and 16 is an upwardly extending channel 20 which mounts an edge control platform 21 for transverse movement across the frame of the machine. The edge control platform keeps the edge of the laid cloth straight. Pedestals 22 and 23, which are essentially mirror images of each other, extend upwardly from the upper surface of the edge control platform and carry the roll of cloth 24 which is mounted on mandrel 25 supported on antifriction bearings 26 (FIG. 16) located near the top of pedestal 22 and corresponding antifriction bearings (not shown) on pedestal 23. A disc brake mechanism 27 is associated with mandrel 25 for selectively braking cloth roll 24 under certain circumstances, as will appear hereafter. The web of cloth 29 leaving roll 24 passes under idler roller 30 (FIGS. 1 and 16) and thereafter passes under idler roller 31 extending between side frame portions 32 and 33 which are rigidly attached to the tops of side frame portions 15 and 16, respectively. Thereafter, the web 29 passes under wrap roller 33 mounted at the ends of arms 34 (FIG. 16) and 35 (FIG. 1) which are pivotally mounted at 36 and 37, respectively, on frame members 32 and 33', respectively. Thereafter, the web 29 passes over positive drive feed roller 39 (FIGS. 1, 16 and 24) and thereafter passes under dancer bar roller 40 which is mounted for idle rotation at the outer ends of arms 41 and 42' (FIGS. 24 and 33), the inner ends of which are pivotally mounted on shaft 43' extending between side frame members 32 and 33'. The web 29 then passes over idler roller 42 which is journalled on shaft 43'. Thereafter the web passes through the tucking mechanism 43 from which it is deposited on the table and the ends of the cloth are held by a catcher blade 194, as will appear hereafter.

As noted above, one aspect of the present invention is that the frame of the machine is fabricated of materials which provide rigidity to the frame in the required directions but which permit the frame to flex as required to follow undulations in the surface of the laying table, thereby avoiding the shocks which would otherwise be incurred with a rigid frame which could not allow such undulations smoothly. Furthermore, the frame is relatively lightweight, as compared to prior cast frames, thereby permitting larger weight cloth rolls to be carried more safely on existing tables. This is of importance considering that the mills now make rolls of cloth which weigh up to 1,000 pounds whereas previously the rolls weighed much less. In the foregoing respect, most existing cutting room tables were fabricated before large 1,000 pound rolls came into vogue and therefore cannot safely carry the loading of larger rolls unless the weight of the machine is reduced. In addition to the foregoing, the frame is built up from modules so that during fabrication modules of different standard sizes can be assembled for different types of machines.

In accordance with the foregoing objectives of reducing the weight of the machine while maintaining its strength and permitting it to flex in certain directions, the machine frame 9 includes first and second dished side frame members 15 and 16 which are fabricated from plate aluminum, but can be fabricated from other materials. Side frame members 15 and 16, which are essentially mirror image counterparts, include planar central portions 45 and 46, respectively, bounded by flanges 47 and 48, respectively, said flanges extending perpendicularly on all four sides of their respective central plate members, as can be seen from FIGS. 3, 6 and 7. The continuity of flanges 47 and 48, on all four sides of central plate members 45 and 46, respectively, causes the side frame members to be extremely rigid so that they cannot flex. Essentially the strength of the side frame members is due to their dished configuration.

Figures 6, 7, 8, 9, 10:
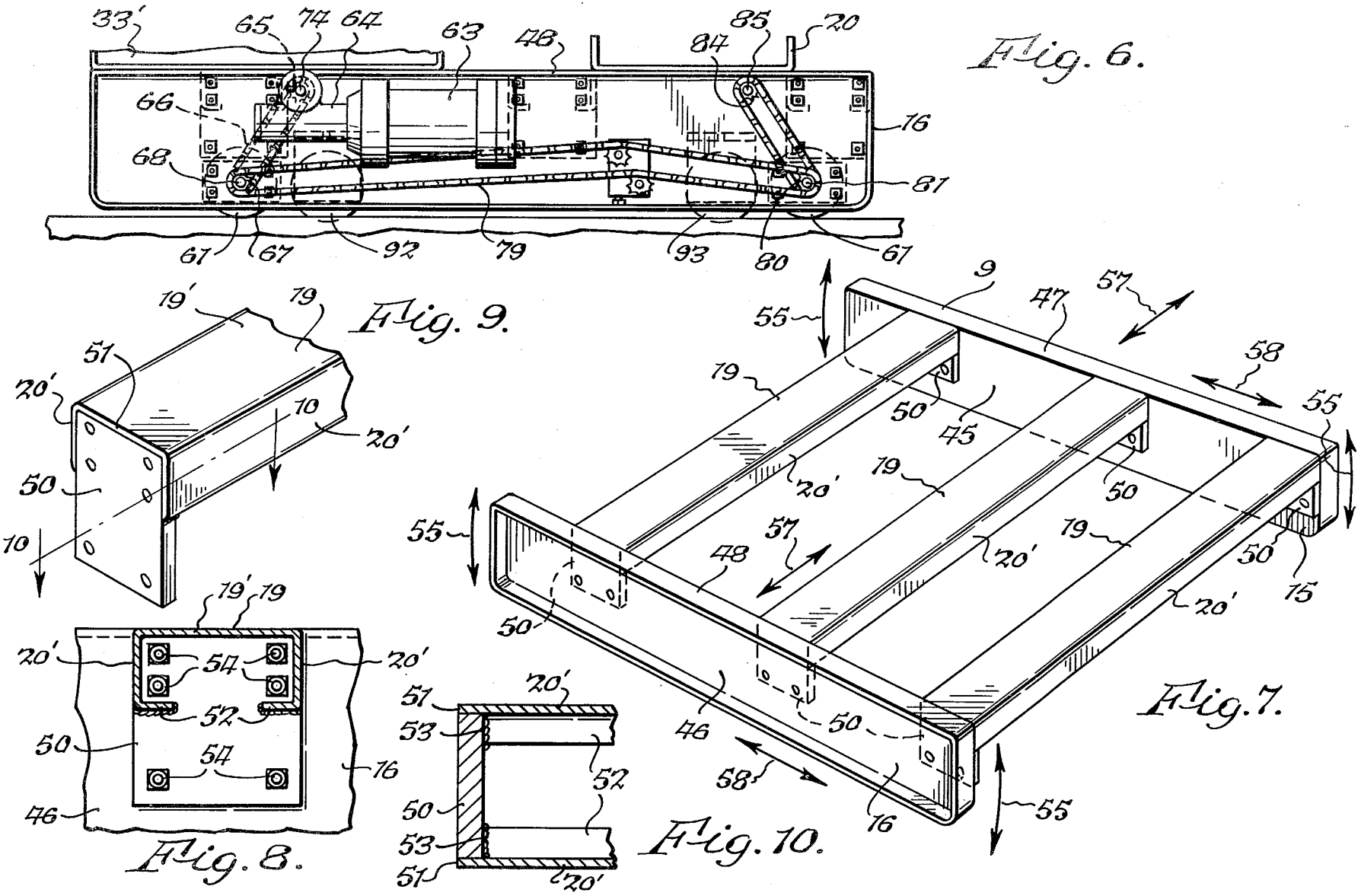
FIG. 6 is a view taken substantially along line 6—6 of FIG. 2 and showing essentially the other side frame of the machine mounting the support wheels, the drive motor and various drive linkages therebetween.
FIG. 7 is a perspective view of the improved frame of the machine having dished side frame members interconnected by cross frame members of channel-shaped configuration.
FIG. 8 is a fragmentary cross sectional view taken substantially along line 8—8 of FIG. 2 and showing the structure for mounting the channel-shaped cross frame members on the side frame members.
FIG. 9 is a fragmentary perspective view of the construction of the end of the cross-frame member which is attached to the side frame member.
FIG. 10 is a fragmentary cross sectional view taken substantially along line 10—10 of FIG. 9.

Cross frame members 19 (FIGS. 2, 3, 7 and 8) are channel-shaped in cross section. Channel members 19 (FIG. 8) include a web portion 19', leg portions 20', and flanges 52 connected to leg portions 20' at the opposite ends thereof from web portion 19'. Plates 50 are welded within the ends of each of channels 19 so that the outer side of each plate 50 is squared with edge 51 of each of the channels (FIGS. 9 and 10), and to this end, portions of channel legs 52 are cut away at 53. Plates 50 are secured to channels 19 by welding at all seams therebetween. Plates 50 are secured to the opposite side frame members 15 and 16 by nut and bolt assemblies 54 (FIG. 8).

Side frame members 15 and 16 can move in a vertical plane in the direction of arrows 55 (FIG. 7) because of the fact that each of the channel members 19 may twist generally about its longitudinal axis in response to the passage of the frame over undulations on the table surface 12. However, the rigidity of the plates 50 attached to central portions 45 and 46 of the side frame members will permit practially no movement of the side frame members in the direction of arrows 57. Thus, side frame members 15 and 16 will not tilt from side to side, but will maintain a completely vertical orientation at all times. In this respect, the edge control platform, described in greater detail hereafter, may cycle back and forth crosswise of the machine as much as 50 times per layer of cloth, and when a 1,000 pound roll is being carried on the edge control platform, there is an extremely large force tending to cause side sway of the machine, which is obviated by the present construction. In addition, channel members 19 will prevent side frame members 15 and 16 from experiencing relative front and rear translational movement, that is, channels 19 will prevent side frame members from "walking" relative to each other in the direction of arrows 58. In this respect, when the carriage is traveling, one side frame member 15 cannot move out ahead in the direction of movement relative to the other side frame member. They will maintain their exact positions relative to each other in the direction of motion of the carriage. This will obviate canting which was experienced with prior constructions wherein the side frame members moved forwardly and rearwardly relative to each other and thereby caused the orientation of the roll of cloth on the machine to depart from exact perpendicularity with the direction of travel, which, in turn, caused the cloth to be laid in a crooked path. Summarizing the foregoing, side frame members 15 and 16 can move in the direction of arrows 55 but cannot move relative to each other in the direction of arrows 58 nor can they move in the direction of arrows 57. It is to be especially noted that the cross frame members 19 are lightweight and strong, yet afford flexibility in the required directions. It is also to be noted that all the cross frame members need not be channel-shaped, but that a sufficient number of channel-shaped members or shapes of equivalent construction should be used to obtain the required characteristics. Thus, a construction is provided which permits flexing of the frame to smoothly follow undulations of the cutting table but will not permit movement of the frame members in a direction which would affect the orientation of the cloth which is laid.

At this point it is to be noted that the frame 9 is fabricated from modules. These modules essentially comprise the side frame members 15 and 16 and the dished modules 32 and 33' (FIGS. 1, 3, and 4) which are suitably secured, as by bolts, to the top flanges of dished side frame members 15 and 16, respectively. By use of a modular construction of the foregoing type, various standard frame members can be combined to provide frames having different characteristics.

Figures 2, 3, 4, 5:
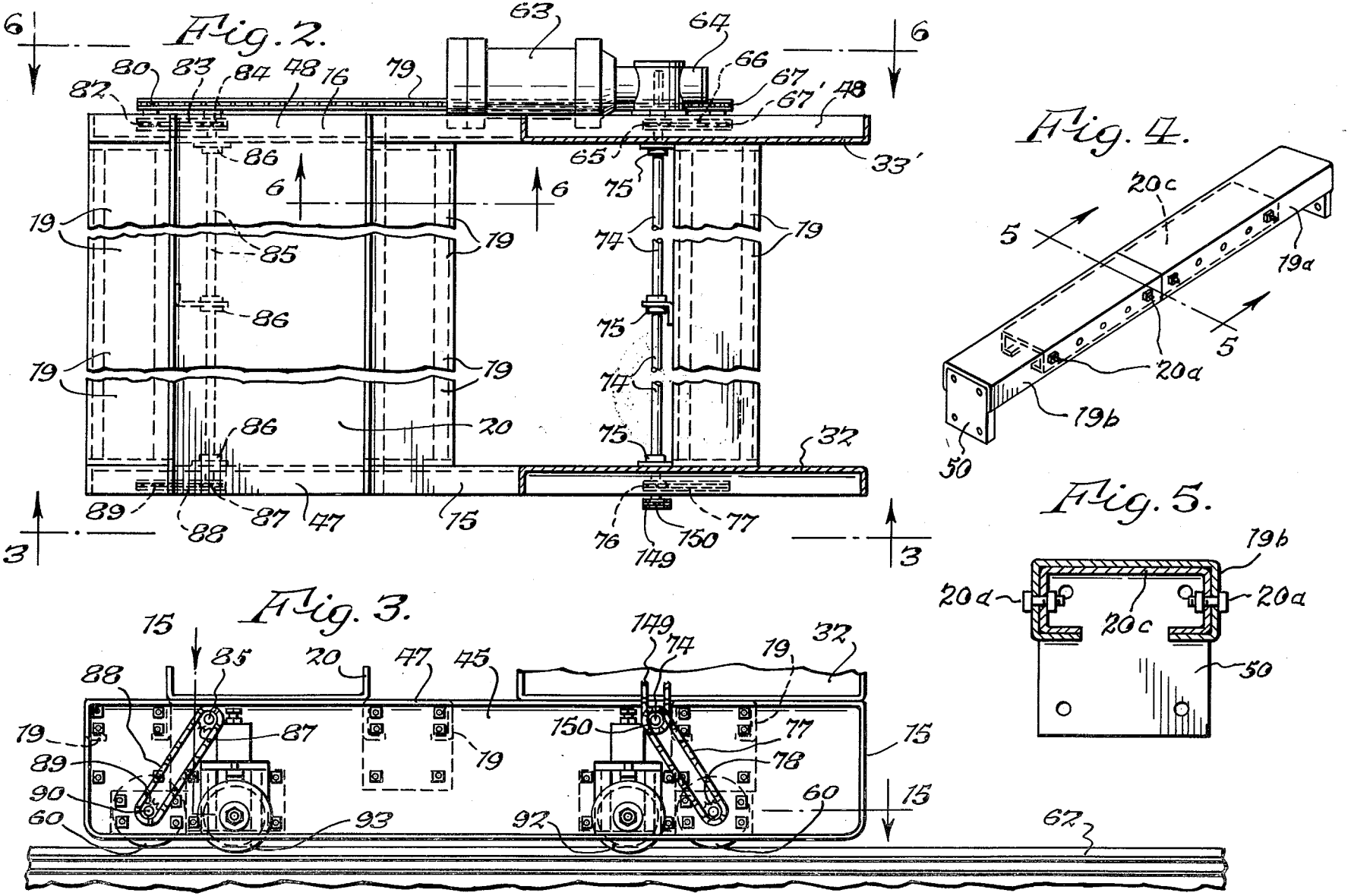
FIG. 2 is a fragmentary view, partially in cross section, taken substantially along line 2—2 of FIG. 1 and showing essentially the frame of the machine, certain parts having been omitted in the interest of clarity.
FIG. 3 is a fragmentary side elevational view taken substantially in the direction of line 3—3 of FIG. 2 and showing essentially one side frame of the machine mounting the guide wheels and the support wheels and also showing portions of the drive linkage associated therewith.
FIG. 4 is a perspective view of a modified construction for expanding the width of the machine.
FIG. 5 is a cross sectional view taken substantially along line 5—5 of FIG. 4.

In accordance with another aspect of the present invention, a construction is provided for permitting selective expansion of the frame so that it can have different widths. The construction for this is shown in FIGS. 4, 4A, 4B and 5. In this respect, instead of using channels which are continuous throughout their length, the channels are divided into halves 19*a* and 19*b*. On the ends of these channels are mounted plates 50 which are identical to those described above. However, channel sections 19*a* and 19*b* can telescope relative to an internal channel 19*c*, which fits within channels 19*a* and 19*b* in complementary mating relationship. Thus, if it is desired to expand the length of the cross member shown in FIG. 4, it is merely necessary to loosen nut and bolt assemblies 20*a*, expand the cross frame member, and thereafter reinsert the nut and bolt assemblies through the proper aligned apertures between sections 19*c*, 19*a* and 19*b*. Similar expanding structure is associated with cross channel 20 (FIG. 16), and edge control platform 21, as shown in FIGS. 4A and 4B. In this respect the edge control platform can be fabricated from two channel halves 21*a* which telescope to the proper size into a central channel 22*a*, with all the members being connected by suitable fasteners, such as bolts which fit through aligned apertures (not numbered) in the telescoped parts. The cross channel which supports the edge control platform may be fabricated from two channel halves 20*a* which are connected by a central channel 23*a* into which they telescope and to which they are secured by suitable fasteners, such as bolts, which fit through aligned apertures (not numbered) in the telescoped parts.

In accordance with another aspect of the present invention, the cloth-laying carriage 10 includes four positively driven ruuber-like wheels which run on the top surface 12 of the cutting table. These wheels primarily provide good weight distribution, and also provide good traction for driving carriage 9 because all four wheels are driven. The wheels also cause the carriage to stop smoothly because all four wheels are braked. In addition, since the wheels carry substantially the entire load of the machine, thus existing standard guide track 62 (FIGS. 1, 11 and 12), may be used to guide the machine and it does not have to be sufficiently strong to support a large proportion of 1,000 pound rolls of cloth in addition to the machine. Wheels 60 are mounted on side frame member 15 (FIG. 3) and wheels 61 are mounted on side frame member 16 (FIG. 6). The term "rubber-like" is meant to include both rubber and plastic materials which will provide a smooth ride as well as good traction. In order to drive wheels 60–61, a drive motor 63 (FIGS. 2 and 6) is suitably mounted on side frame 16. Gear reducer 64 associated with drive motor 63 mounts an output sprocket 65. Chain 66 extends around output sprocket 65 and sprocket 67 keyed to shaft 68 (FIG. 15) to which wheel 61 is also keyed. Shaft 68 is suitably journalled for rotation by bearing 71 in plate portion 46 of side frame 16 and by bearing 72 in bracket 69 which is attached to side frame portions 46 by means of bolts 70. All of the other wheels 61 and 60 are supported on their respective side frame mbmers in a similar manner, as can be seen from FIG. 15 wherein the support for wheel 60 is essentially the mirror image construction of the support for wheel 61. Sprocket 65 (FIG. 2) is keyed to cross shaft 74 which extends between side frame members 16 and 15 and has spaced portions thereof journalled in bearings 75. As can be seen from FIGS. 3 and 6, shaft 74 is well above wheels 60 and 61 so that it will not interfere with lays of cloth received in the opening between side frame members 15 and 16. A sprocket 76 (FIG. 2) is keyed to the end of shaft 74 at side frame member 15 and chain 77 encircles sprocket 76 and sprocket 78 (FIGS. 3 and 15) which is keyed to shaft 68' to which is keyed wheel 60. Thus, wheels 60–61 at the front end of the machine are driven in the foregoing manner.

Wheels 60–61 at the rear end of the machine are driven in a similar manner. In this respect, a chain 79 (FIG. 6) encircles sprocket 67' (FIG. 15) on shaft 68 and sprocket 80, which is keyed to shaft 81, to which wheel 61 is also keyed. In this manner the latter wheel 61 is driven. A sprocket 82 is also keyed to shaft 81 and is encircled by chain 83 which also encircles sprocket 84 keyed to shaft 85 (FIGS. 2 and 6) supported in bearings 86 and mounting sprocket 87 (FIG. 3) at the end thereof which terminates in side frame 15. A chain 88 encircles sprocket 87 and sprocket 89 which is keyed to shaft 90 to which wheel 60 is also keyed (FIG. 3). Thus, the latter wheel 60 is also positively driven. It is to be especially noted that cross shaft 85 is at the same elevation as cross shaft 74 and that they are both well above the surface of the table to permit lays of cloth to accumulate under these cross shafts. By virtue of the foregoing positive drive arrangement to the four rubber-like wheels 60–61, good positive traction is attained with the surface 12 of the table, both for driving the carriage and for slowing it down when it is being braked. Because all the wheels are driven, there is no tendency for the machine to cant or twist either while being driven or while being braked. Furthermore, it is to be especially noted that the wheels 60 and 61 are positioned substantially directly above the table legs on both sides of the table so that the carriage is supported at the strongest parts of the table, namely, over the leg braces.

Figures 11, 12, 13, 14, 14A, 14B, 15:
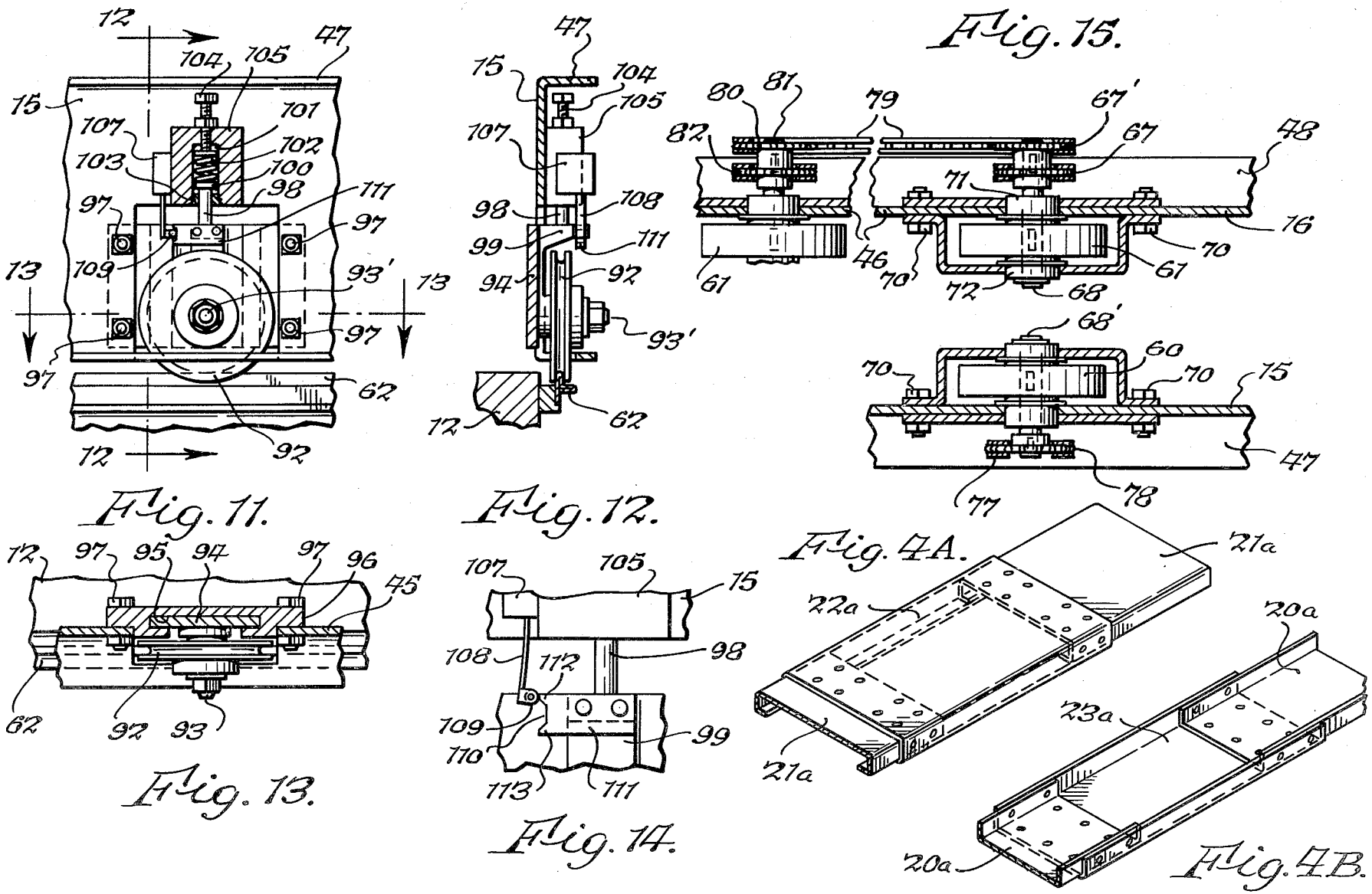
FIG. 11 is a fragmentary enlarged front elevational view of the guide wheel assembly.
FIG. 12 is a fragmentary cross sectional view taken substantially along line 12—12 of FIG. 11.
FIG. 13 is a fragmentary cross sectional view taken substantially along line 13—13 of FIG. 11.
FIG. 14 is a fragmentary enlarged view showing the control switch associated with the guide wheel.
FIG. 15 is a fragmentary cross sectional view taken substantially along line 15—15 of FIG. 3 and showing essentially the manner in which the load-bearing wheels are mounted on the side frame members.

In accordance with another aspect of the present invention, carriage 10 is guided for movement on cloth-laying table 12 by means of nonload bearing guide wheels 92 and 93 which receive track 62 (FIGS. 3, 11 and 12). While wheels 92 and 93 are shown as being grooved, it will be appreciated that sprocketed or other types of wheels may also be used. Since the structure for mounting guide wheel 93 is identical to that for mounting guide wheel 92, only the latter will be described, and it will be understood that the following description also applies to wheel 93. Grooved wheel 92 is mounted on shaft 93' which is supported on plate 94 which is slidably mounted in undercut portion 95 of block 96 which is attached to central plate 45 by means of bolts 97. Thus, shaft 97 will move vertically up and down with plate 94 as the latter moves in undercut groove 95. Pin 98 has its lower end attached to boss 99 on plate 94 and its upper enlarged end 100 is received in chamber 101 in which spring 102 is housed. A screw cap 103 prevents cap 100 of stem 98 from being pushed out of chamber 101 when spring 102 expands. An adjusting screw 104 is threaded through the top of block 105 in which chamber 101 is located and its lower end bears on spring 102. The adjustment of screw 104 will vary the force with which stem 98 and guide wheel 92 attached thereto is biased downwardly into engagement with track 62. The force of spring 102 is adjusted to provide sufficient force of engagement between wheel 92 and track 62 so that the wheel will maintain firm engagement therewith, without loading track 62 excessively. Furthermore, the spring mounting will permit the wheel 92 to maintain the desired firm engagement with track 62 notwithstanding slight undulations in the track which would cause the wheel 92 to ride up and down. It is to be especially noted that guide wheels 92 and 93 are not load-bearing. Therefore, no more weight of the carriage is transmitted to track 62 than is due to the adjustment of the spring associated with each guide-wheel.

An arrangement is provided for stopping the machine in the event either wheel 92 or 93 should leave track 62 or move beyond a predetermined point. In this respect, a switch 107 is mounted on block 105. Switch arm 108 has an end portion 109 which is received in groove portion 110 of cam 111 which is mounted on stem 98. As long as end portion 109 remains in groove 110, during slight up and down movement of wheel 92, the carriage will remain in operation. However, if for any reason end 109 (FIG. 14) is engaged by cam portions 112 or 113 as a result of excessive vertical movement of wheel 92, switch 107 will disrupt power to motor 63 (FIG. 2) to thereby stop carriage 10. The excessive vertical movement will be experienced when the table undulates an excessive amount so that cloth cannot be laid satisfactorily or when for some reason the track 62 departs from the desired parallelism with the table top 56 or when for any reason the track is broken or excessively distorted. Furthermore, it is to be especially noted that both guide rolls 92 and 93 (which are identical to each other) must maintain contact with track 62 for the machine to operate. If either one loses contact with the track, the machine will stop because each guide wheel 92 and 93 has a switch 107 and related structure associated therewith. Since two guide wheels 92 and 93 are used, the carriage 10 must run down the table in parallel relationship to track 62, because if it does not, one or the other of guide rolls 92 or 93 will leave track 62 and cause the machine to stop. Thus the use of two guide wheels spaced longitudinally of the frame tends to insure a straight path of movement of the machine. In addition, it is to be noted that the guide wheel switches act as a safety control to insure proper alignment when the machine is transferred onto a new table.

Figure 18:
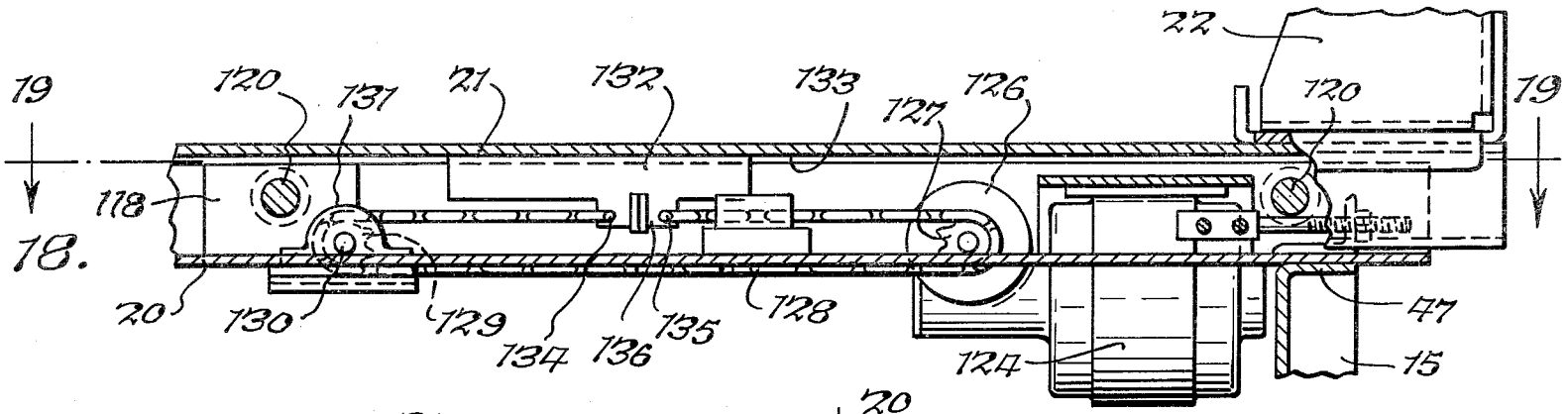
FIG. 18 is a fragmentary cross sectional view taken substantially along line 18—18 of FIG. 16 and showing certain of the drive mechanism for reciprocating the edge control platform.
Figure 19:
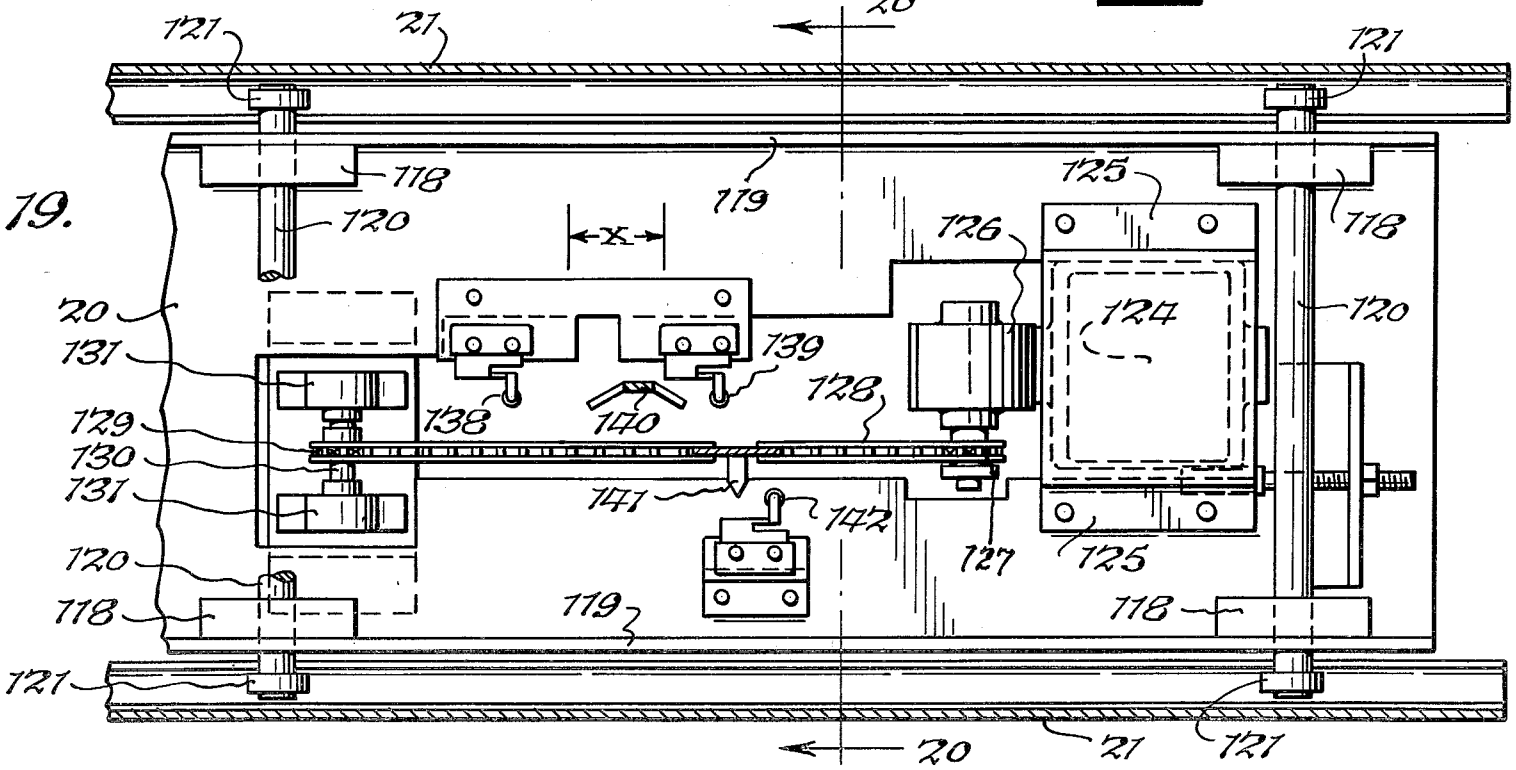
FIG. 19 is a fragmentary cross sectional view taken substantially along line 19—19 of FIG. 18 and showing further details of the edge control platform including the various limit switches associated therewith.

As noted above, edge control platform 21, which is essentially a channel member, rides on channel 20 which has its opposite ends affixed, as by bolts, to side frame members 15 and 16. Edge control platform 21 has structure associated therewith for causing it to hunt back and forth transversely of the direction of movement of the machine to maintain the edges 115 of the lays of cloth straight. To this end an electric eye mechanism 116 (FIGS. 1 and 33) is mounted on frame member 32 and is directed at the edge 117 of web 29. As more or less of the edge is viewed by electric eye mechanism 116, the edge control platform 21 will be caused to hunt in a compensatory manner to keep edge portion 117 straight so that the edges 115 of the lays of cloth will be in line with each other. Spaced blocks 118 (FIGS. 16, 18 and 19) are suitably secured against upstanding legs 119 of channel 20. Shafts 120 extend through blocks 118 and legs 119 and mount rollers 121 at their outer ends. It is to be understood that a total of three shafts 120 are used and that the third shaft is spaced to the left of the shaft 120 in FIG. 19 the same amount as the two shafts shown therein are spaced from each other. In other words, three shafts 120 are used to support the edge control platform 21. Rollers 121 are received in channels 122 rigidly secured relative to legs 123 of platform channel 21. A motor 124 is mounted on support channel 20 by means of brackets 125 and the output shaft of gear reducer 126 associated with motor 124 mounts a sprocket 127 at its outer end which is encircled by chain 128 which also encircles a sprocket 129 mounted on shaft 130 mounted on the web of channel 20 by pedestal members 131 (FIG. 19). A block 132 is rigidly affixed to the underside 133 of platform 21 and the ends 134 and 135 of chain 128 are secured to boss 136 at the bottom of block 132. It can, therefore, be seen that as motor 124 hunts back and forth in response to the intelligence provided by electric eye 116, edge control platform 21 will reciprocate transversely of the direction of movement of carriage 10 to maintain the edge of the laid cloth straight. It is to be especially noted at this point that it is this cycling of the edge control platform which places a tremendous cross strain on the machine. The edge control platform may cycle back and forth as many as fifty times per layer. With a conventional machine, there would be a great deal of side-sway which is obviated by the present construction, as discussed above.

The edge-control platform 21 and its supporting structure 20 are both essentially fabricated from channel-shaped members which will provide sufficient strength to carry the roll of cloth 24 without being so massive so as to add excessive weight to the carriage. It is to be especially noted that the channel shape of members 20 and 21 permit them to flex about their longitudinal axes so as to follow the flexing of the remainder of the frame, as discussed in detail above.

The normal range of movement of edge control platform 21 is depicted by distance X in FIG. 19. In the event that this distance is exceeded, motor 124 will be caused to stop. In this respect, a pair of limit switches 138 and 139 are mounted on support member 20 and are engaged by a cam 140 mounted on the underside of platform 21, in the event that platform 21 should move to this extent, and this engagement will disrupt the power supply to the motor 124 and stop the platform before mechanical binding is experienced. In addition, a dog 141 is secured to chain 128 and this dog will engage switch arm 142 in the event that cloth roll 24 has been completely laid so that there is no more cloth to be viewed by the electric eye. The actuation of switch 142 will cause carriage driving motor 63 to stop. The parameters are such that switch 142 will be actuated slightly before switch 138, so that the carriage will stop slightly before the edge control platform.

Figures 16, 17:
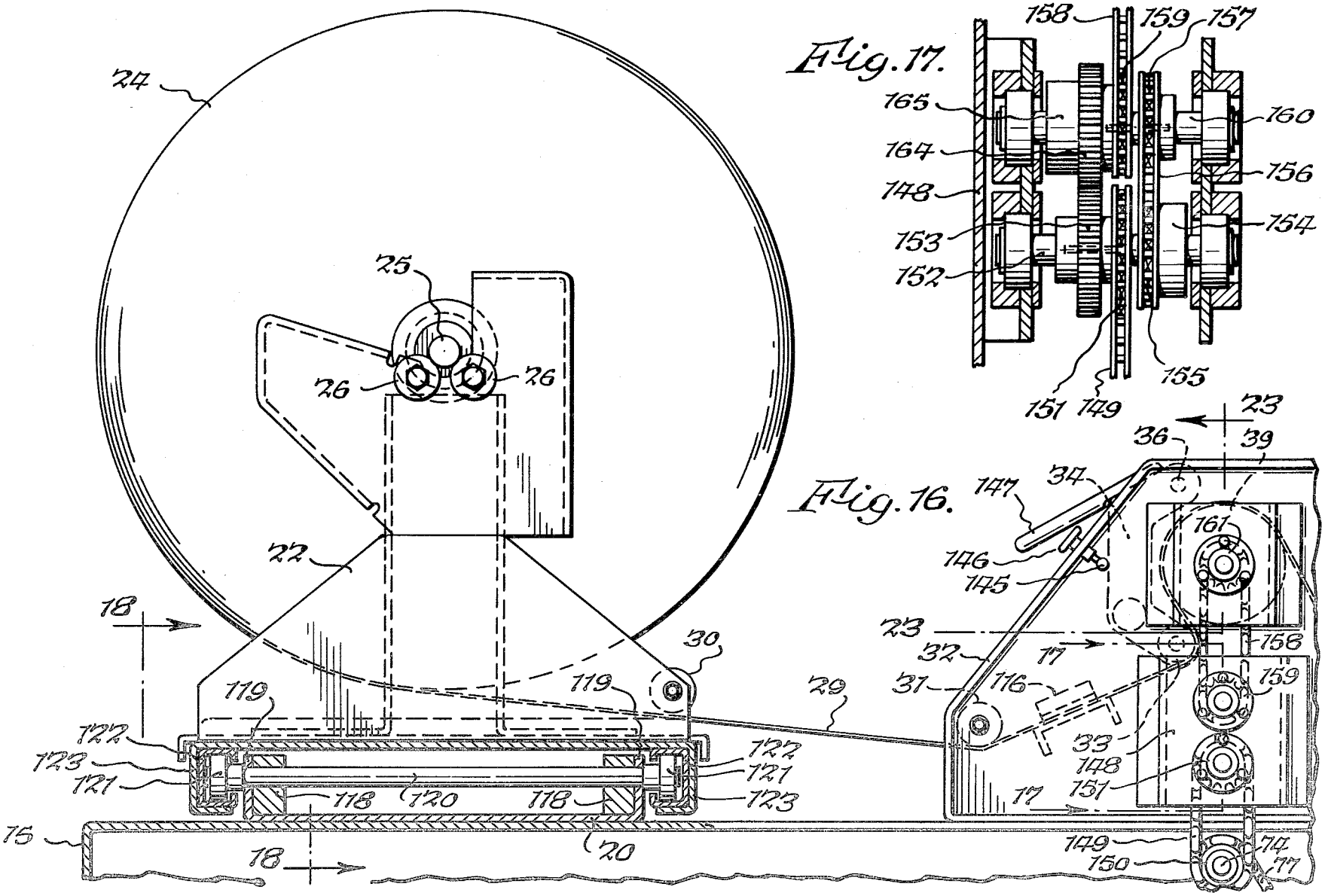
FIG. 16 is an enlarged side elevational view showing essentially the relationship of the various parts of the machine located between the cloth roll supporting structure and the feed roller.
FIG. 17 is a fragmentary cross sectional view taken substantially along line 17—17 of FIG. 16 and showing the drive mechanism for causing the feed roller to always rotate in the same direction regardless of the direction of movement of the cloth-laying machine.

As noted previously, the web 29 is caused to pass around positive drive feed roller 39 (FIG. 16). To this end, a wrap roller 33 is utilized to cause the web to contact a relatively large circumferential portion of feed roller 39. Arms 34 and 35 associated with wrap roller 33 are caused to remain in the position shown in FIG. 16 by means of a spring-biased slide lock detent 145 (FIGS. 16 and 33) which bears on arm 34. If it is desired to swing arm 34 in a clockwise direction about its pivot point 36, as may be required in threading the web about the feed roller, it is merely necessary to pull knob 146 to release arm 34 and thereafter handle 147 attached to arm 35 is grasped to swing arm 34 in a clockwise direction.

Figures 20, 21, 22, 23, 32A, 32B:
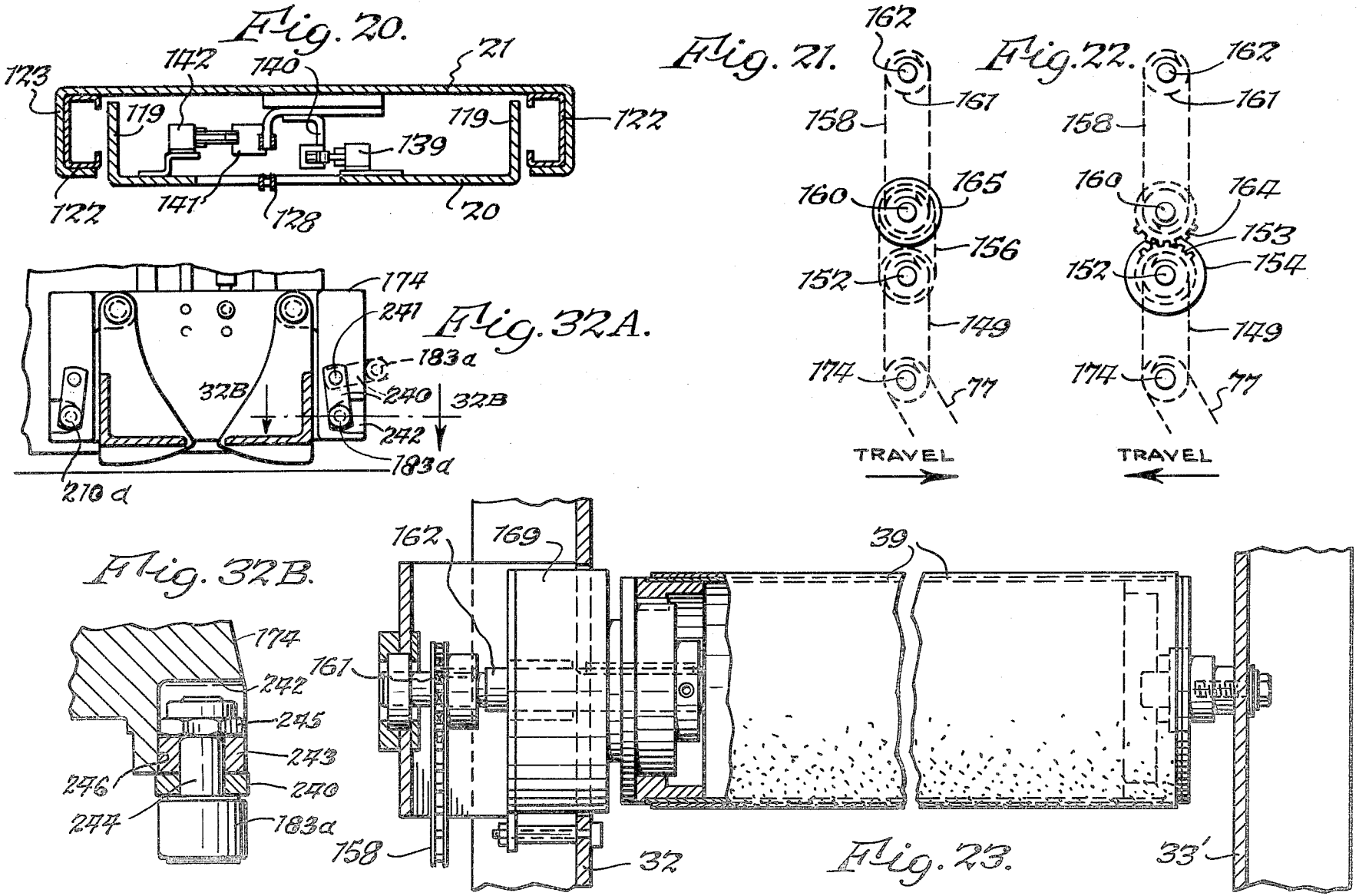
FIG. 20 is a cross sectional view taken substantially along line 20—20 of FIG. 19.
FIGS. 21 and 22 are schematic views showing the manner in which the structure of FIG. 17 operates to cause the positive drive feed roller to always rotate in the same direction regardless of the direction of movement of the machine.
FIG. 23 is a fragmentary view, partially in cross section, taken substantially along line 23—23 of FIG. 16 and showing essentially the drive associated with the positive drive feed roller.
FIG. 32A is a side elevational view of an alternate construction for actuating the catcher blade assembly.
FIG. 32B is a fragmentary cross sectional view taken substantially along line 32B—32B of FIG. 32A.

Positive drive feed roller 39 always rotates in a clockwise direction in FIG. 16 regardless of whether carriage 10 is moving from right to left or left to right. In order to effect such clockwise movement of feed roller 39, a reversing unit 148 (FIGS. 16 and 17) is provided. Reversing unit 148 is driven by chain 149 (FIGS. 3, 16 and 17) which encircles sprocket 150 on shaft 74, sprocket 150 being driven by chain 77. Chain 149 also encircles sprocket 151 which is mounted on shaft 152 which also mounts gear 153 and one-way clutch 154. When chain 149 is moving in a first direction, clutch 154 will be engaged and a sprocket 155 thereon will drive chain 156 to drive sprocket 157 which drives chain 158 because of its encircling engagement with sprocket 159 on shaft 160. Chain 158 enricles sprocket 161 (FIGS. 16 and 23) which is keyed to shaft 162 to which positive drive feed roller 39 is also keyed. During the foregoing action, gear 153, which is also keyed to shaft 152, will drive gear 164 which has one-way clutch 165 associated therewith. However, the direction of rotation of gear 164 will be such that clutch 165 will not drive shaft 160. If the direction of movement of chain 149 is opposite to that described above, one-way clutch 154 will be inactive and gear 153 will drive gear 164 in a direction which will cause one-way clutch 165 to drive shaft 160. Regardless of the direction in which chain 149 is traveling, shaft 160 will always be driven in the same direction to thereby cause chain 158 to always be driven in the same direction to thereby cause feed roller 39 to always be driven in the same direction regardless of the direction of travel of cloth-laying machine 10 on the table. The foregoing action is schematically shown in FIGS. 21 and 22. It is to be especially noted that the gear ratio of the various sprockets is such that the peripheral linear speed of positive drive feed roller 39 is slightly greater than the linear speed of the carriage 10 on the table so that the cloth will be laid down without any pulling or without excess.

Figures 24, 25, 26:
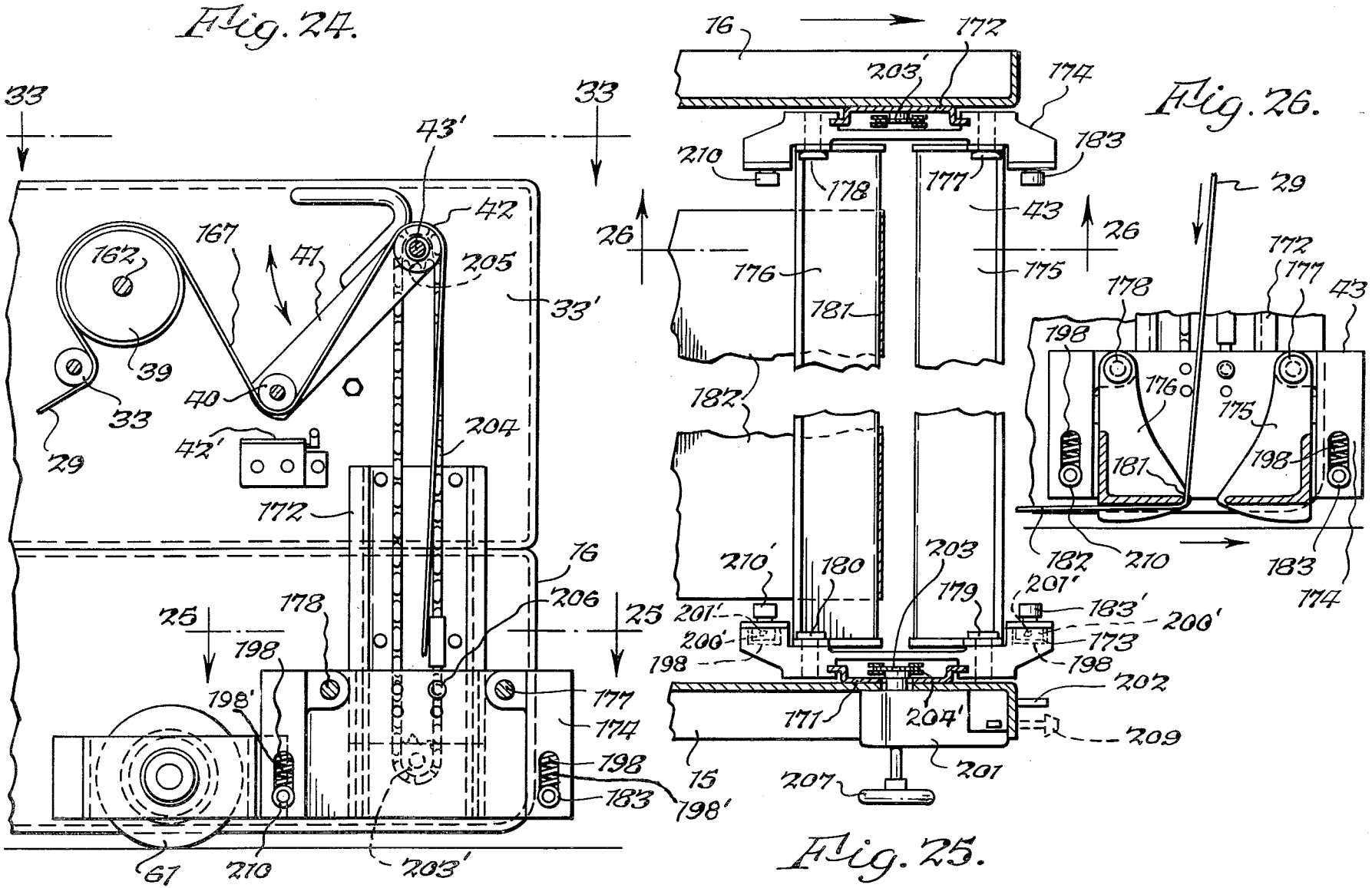
FIG. 24 is a fragmentary side elevational view which is essentially a continuation of the structure at the right of FIG. 16 and also showing the dancer bar resting on the portion of the web leaving the positive drive feed roller and also showing certain portions of the tuck bar mechanism for creating folds at the ends of the cloth lays.
FIG. 25 is a fragmentary cross sectional view taken substantially along line 25—25 of FIG. 24 and showing essentially the block structure for supporting the tuck bar mechanism.
FIG. 26 is a fragmentary cross sectional view taken substantially along line 26—26 of FIG. 25 and showing the position of the tuck bars when the machine is moving to the right in the direction of the arrow but before it has reached the end portion of the table.

In FIGS. 24 and 25 the dancer bar or roller 40 is shown bearing downwardly on the loop 167 of the portion of the web 129 between feed roller 39 and idler roller 42. The dancer bar 40 maintains this loop taut and rises and falls with the demand of fabric which is to be laid on the table. In so doing, arms 41 and 42', which are pivotally mounted, will move in the direction of the arrows of FIG. 24. In the event there is too much web being fed by roller 39, as might be the case when the machine is slowing down, arm 41 will drop to actuate switch 42" and as a result the magnetic clutch 169 (FIG. 23) on feed roller shaft 162 will be energized momentarily to disengage feed roller 39 from its drive linkage. Also, as a result of the actuation of switch 42" disc brake 27 will be activated to slow down the rotation of cloth roll 24. The activation of brake 27 is through a time-delay circuit so that the activation is momentary. As the size of loop 167 decreases, arm 41 will swing in a clockwise direction and switch 42" will be deenergized.

Figure 27:
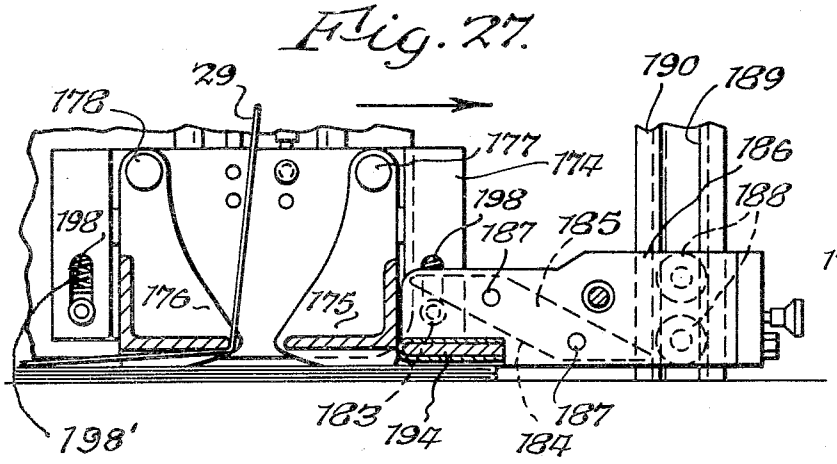
FIG. 27 is a view similar to FIG. 26 but showing the relationship of the tuck bar mechanism to the catcher assembly substantially at the time that it contacts the latter.
Figures 33, 34:
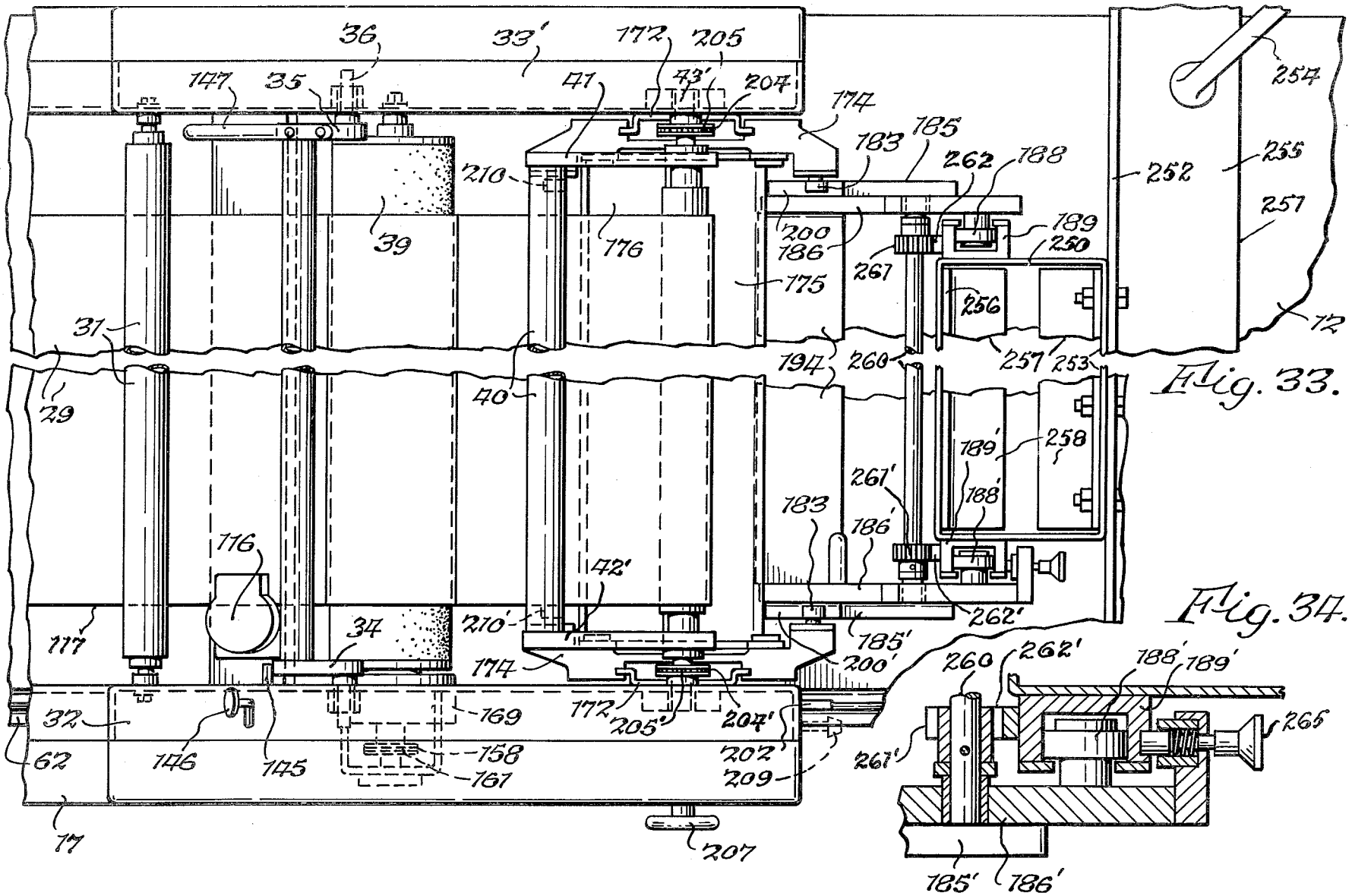
FIG. 33 is a fragmentary plan view taken substantially along line 33—33 of FIG. 24.
FIG. 34 is a fragmentary cross sectional view taken substantially along line 34—34 of FIG. 31.

In accordance with another aspect of the present invention, the cloth-laying machine includes an improved tuck bar and catcher combination for creating folds at each end of travel of the machine and for holding such folds in position. In this respect, track plates 171 and 172 (FIGS. 24 and 25), which are mirror image counterparts, have their lower ends affixed to frame sides 15 and 16, repectively, and have their upper ends affixed to frame sides 32 and 32', respectively. Tuck bar carrying blocks 173 and 174, which are mirror image counterparts, are mounted for vertical sliding movement on track plates 171 and 172, respectively. First ends of tuck bars 175 and 176 are pivotally mounted on block 174 by pins 177 and 178, respectively. The opposite ends of tuck bars 175 and 176 are pivotally mounted by analogous pins 179 and 180, respectively, on block 173. As the carriage travels in the direction of the arrow in FIG. 26, the web 29 will pass across the leading edge 181 of tuck bar 176 to form the uppermost lay 182. This action will continue into FIG. 27 until roller 183 at the end of block 174 (FIG. 25) passes under side 184 of cam 185 which is affixed to catcher arm 186 by screws 187. An analogous action will occur when roller 183' on block 173 coacts with cam 185' which is mounted on catcher arm 186'. Cam 185' and catcher arm 186' are mirror-image counterparts of cam 185 and catcher arm 186, respectively (FIG. 33). Catcher arm 186 has rollers 188 thereon which ride in track 189 of standard 190. As can be seen from FIG. 33, catcher arm 186' has rollers 188' thereon (which are mirror-image counterparts of rollers 188) which ride in track 189' (which is the mirror-image counterpart of track 189). Since both sides of the catcher arrangement operate in an identical manner, only one side will be described in the interest of simplicity.

Figure 29:
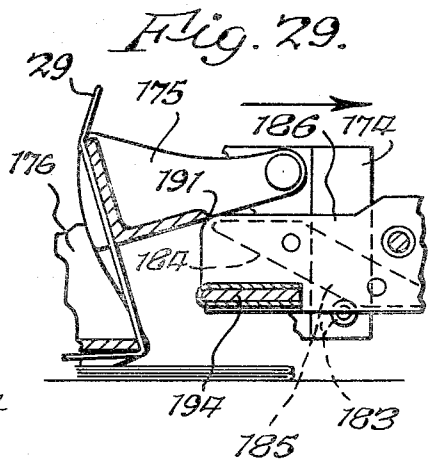
FIG. 29 is a view similar to FIG. 28 but showing the position of the parts as tucking of the cloth progresses.
Figure 28:
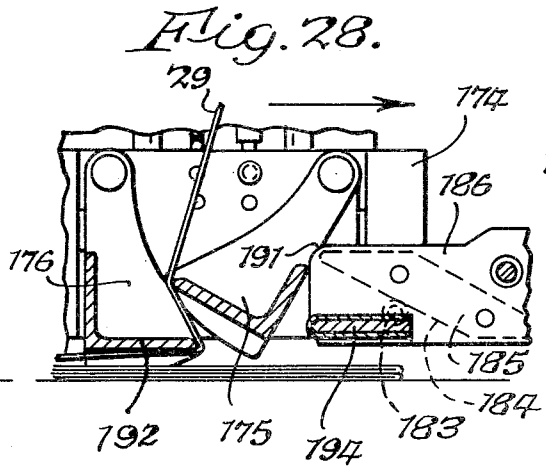
FIG. 28 is a view similar to FIG. 27 but showing the relationship of the parts as tucking of the cloth is initiated.
Figure 31:
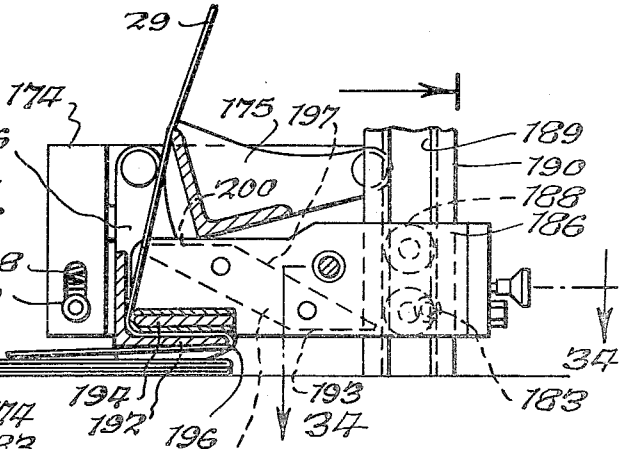
FIG. 31 is a view similar to FIG. 30 but showing the positions of the parts at the point of reversal of the carriage.
Figure 30:
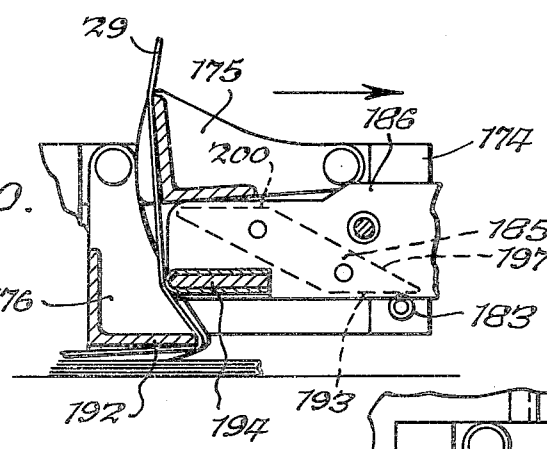
FIG. 30 is a view similar to FIG. 29 but showing a view as tucking progresses still further.

As roller 183 continues to move to the right to the position shown in FIG. 28, catcher arm 186 will continue to be lifted by roller 183 and the corner 191 of catcher arm 186 will pivot tuck blade 175 in a clockwise direction so that web 29 will start to fold over the horizontal portion 192 of tuck blade 176. An analogous action is performed by roller 183' and block 186'. This movement will continue as shown in FIG. 29 and a point will be reached when roller 183 rides under the horizontal portion 193 (FIG. 30) of cam 185. At this time catcher blade 194, which is suspended between catcher arms 186–186', will be in the position shown in FIG. 30. Thereafter, a point will be reached when roller 183 is no longer supporting the underside 193 of cam 185 and roller 183' is no longer supporting the underside of cam 185' and catcher arms 186 and 186' will drop to cause catcher blade 194 to create the fold 196 around tuck blade 192. This occurs at the point of reversal of block 174. After block 174 starts moving to the right, roller 183 will ride up on surface 197 of cam 185. An analogous action occurs between roller 183' and cam 185'. However, it can be seen from FIGS. 26, 27 and 31 that roller 183 rides upwardly in slot 198 in block 174.

Figure 32:
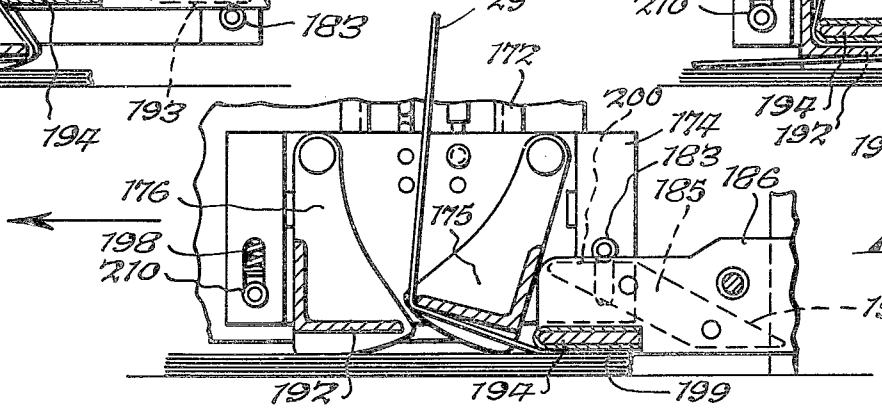
FIG. 32 is a view similar to FIG. 31 but showing the positions of the parts after the carriage starts its movement in the opposite direction.

Thus, all that will happen is that roller 183 will move from the bottom of slot 198 to the top of slot 198 against the bias of spring 198'. An analogous action is experienced by roller 183. By this time, blade portion 192 of tuck blade 176 will have moved out of the fold at 196. Thereafter, catcher blade 194 will bear downwardly on the end portion 199 where the fold is located as the carriage travels to the left in FIG. 32. It will be seen from FIG. 32 that roller 183 is now traveling on the top surface 200 of cam 185 and roller 183' is traveling on the top surface 200' of cam 185'. After rollers 183 and 183' leave the top surfaces 200 and 200' of cams 185 and 185', respectively, the springs, such as 198' associated therewith, will drive them to the bottom of their respective slots, preparatory to a subsequent cycle. Rollers 210 and 210' on the opposite ends of blocks 174 and 173, respectively, coact with catcher arms (not shown) at the opposite end of the table, which are analogous to catcher arms 186 and 186' and their associated structure. It is to be especially noted that the movement of rollers 183, 183', 210 and 210' in their respective slots under the bias of their associated springs, such as 198', insures good coaction between the blocks 173 and 174, on one hand, and the associated catcher arms 186' and 186, respectively, on the other hand. In this respect, the springs insure that the rollers will return to their lowermost positions to engage the undersides of the cams, and the slots will provide sufficient lost motion to the rollers to permit them to ride over the cams on the return movement of the carriage. At this point it is to be noted that rollers 183, 183', 210 and 210' are suitably mounted on shafts (not numbered) anchored to rectangular blocks 200' (FIG. 25) slidably mounted on pins 201'. Blocks 200' ride in the slots 198 in blocks 173 and 174. It is the incorporation of lost motion connections, such as provided by slots such as 198 or the equivalent structure of FIGS. 32A and 32B which causes the present structure to essentially differ from prior constructions.

In FIGS. 32A and 32B an alternate construction is shown for actuating the catcher bar assembly. In this respect, instead of mounting rollers 183, 183', 210 and 210' in slots, such as 198 in blocks 173 and 174, as shown in FIGS. 24–31, a swinging arm suspension for such rollers is used. Rollers **183*a* and 210*a* are shown in FIGS. 32A and 32B as associated with block 174. Only the manner in which roller 183*a* is mounted will be described, and it will be understood that the remainder of the rollers are mounted in an analogous manner. More specifically, roller 183*a* is mounted at the lower end of arm 240, the upper end of which is pivotally mounted by pin 241 on block 174. A recess 242 is formed in block 174 to receive a washer 243 which is coaxially mounted with roller 183*a* on shaft 244. Shaft 244 is held in position by a nut 245. When block 174 is moving to the right in FIG. 32A, washer 243 will engage wall 246 of recess 242 and this will prevent arm 240 from swinging in a clockwise direction. Therefore, roller 183*a* will ride under cam 185. However, on the return stroke, that is when block 174 is moving to the left in FIG. 32A, arm 240 will pivot counterclockwise to the dotted line position to permit roller 183*a* to ride over cam 185. After roller 183*a* leaves cam 185, arm 240 will drop back to the solid line position shown in FIG. 32A. A reverse action is provided by roller 210*a* and it will be understood that the remainder of the rollers on block 173 are mounted in an analogous manner to roller 183*a***.

In FIGS. 33 and 34 a bracket structure is shown for mounting standards 189 and 189' which support catcher arms 186 and 186'. The bracket structure includes a rectangular frame 250 which rests on the top 12 of the cloth-laying table. An angle 251 has its vertical leg 252 attached to frame side 253. A C-clamp 254 secures one end of the horizontal leg 255 of angle 251 to the table top at one edge of the table, and a corresponding C-clamp (not shown) secures the opposite end of angle 251 to the opposite edge of the table. It can thus be seen that frame 250 can be moved to any desired location on the table, as required. At the opposite end of the table, a fixed arrangement (not shown) is provided which includes a frame, such as 250, and supporting standards, such as 189 and 189'. Affixed to this frame are the vertical legs 256 of angles 257, the horizontal legs 258 of which are screwed to the table top.

At this point it is to be noted that a shaft 260 (FIGS. 33 and 34) has pinions 261 and 261' keyed thereto and shaft 260 has its opposite ends journalled in catcher arms 186 and 186'. Pinions 261 and 261' are in mesh with racks 262 and 262' affixed to the vertical edges of standards 189 and 189'. The pinions 261 and 261' will maintain the parallelism of catcher arms 186 and 186' with each other during the vertical movement of these arms in standards 189 and 189'. A manually actuatable detent 265 is mounted on arm 186' and coacts with standard 189' to maintain the catcher arm 186' in an elevated position, as required.

At this point it is to be noted that the elevation of each block 173 and 174 (FIG. 22) is increased in increments at each end of travel of carriage 10 by a ratchet stepping mechanism. In this respect, a ratchet device is housed in box 201. An actuator bar 202 extends outwardly from box 201 and when it hits an abutment at the end of travel of block 173, it advances the ratchet to rotate drive pinion 203 (FIG. 25) to drive a chain which elevates block 173 a predetermined amount. The chain structure is the mirror image counterpart to the chain structure associated with chain 204 shown in FIG. 24 in association with block 174. In this respect, a sprocket 203' (which is analogous to sprocket 203) is mounted on block 174 and the chain 204 which encircles it also encircles sprocket 205 keyed to shaft 43' mounted on frame member 33'. Block 174 is fixed to chain 204 by pin 206. As chain 204' (FIG. 25) associated with block 173 is advanced by sprocket 203, it will drive a sprocket 205' (FIG. 33) which is keyed to one end of shaft 43' which extends between sides 32 and 33'. This results in the turning of sprocket 205, which is also keyed to shaft 43', to thereby drive chain 204 to lift pin 206 and block 174 attached thereto. In other words, the blocks 173 and 174 are moved in unison through the foregoing linkage. The ratchet mechanism 201 contains structure for adjusting the distance that blocks 173 and 174 will be moved upwardly. As noted above, the chain structure associated with block 173 is identical to that described previously with respect to block 174. Furthermore, a handle 207 is keyed to shaft 208 on which sprocket 203 is mounted so that the latter can be rotated manually to effect the initial height adjustment of blocks 173 and 174. In addition, a release pin 209 is associated with ratchet mechanism 201 to permit block 173 to move downwardly for resetting the machine.

Figure 35:
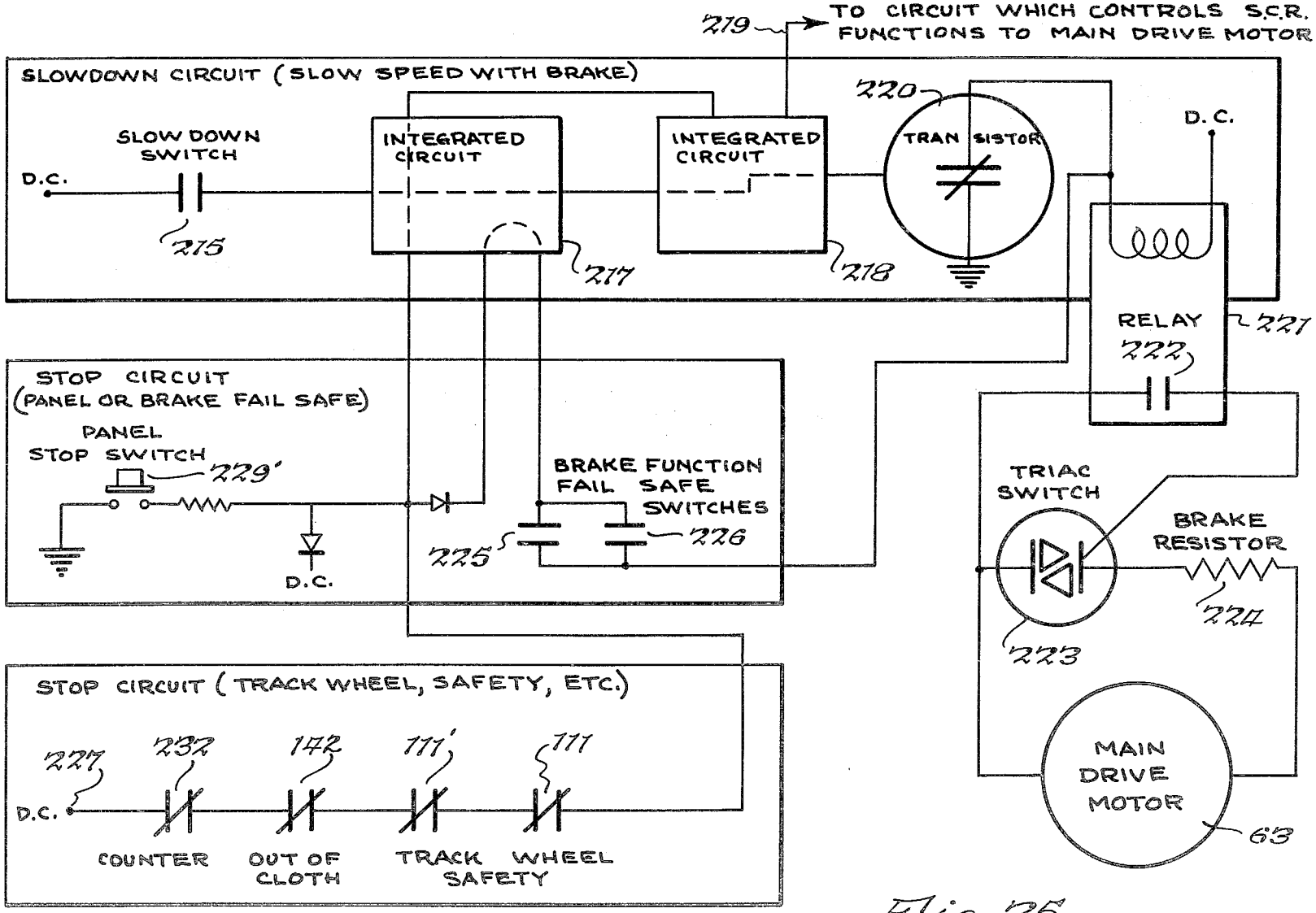
FIG. 35 is a schematic view of certain portions of the electrical circuit associated with the main drive motor.

In FIG. 35 a schematic electrical circuit is shown. Mounted on the carriage 9 is a slow-down switch 215 (FIG. 1) which is actuated by cam track 216 mounted on table 11. When normally open slow-down switch 215 is closed by engaging track 216, integrated circuits 217 and 218, which are logic circuits, are activated. This produces an output in line 219 to a SCR which controls the slowing down of the main drive motor. At the same time transistor 220 stops conducting and this will cause the brake relay 221 to lose its voltage and its normally open contact 222 will close. This causes the triac switch 223 to conduct to thereby place the dynamic brake resistor 224 across main drive motor 63 to effect braking. Switches 225 and 226 (FIGS. 1 and 35) are located on opposite sides of slow-down switch 215. The circuit is such so that in the event switch 215 does not actuate its associated circuit, switch 225 upon engaging cam track 216 will actuate the slow-down and braking circuits. It will be appreciated that a track analogous to 216 is located at the left end of the table. When switch 215 engages the analogous track, it will actuate the slow-down and braking circuit. In the event the circuit associated with switch 215 is not activated by the analogous cam track, then switch 226, which is also a fail-safe switch, will activate the slow-down and braking circuit. However, the circuit is such so that if switch 215 properly activates the slow-down and braking circuit, switches 225 and 226 will not activate the circuits associated therewith, even though they are closed because of contact with their respective cam tracks, such as 216. The purpose of switches 225 and 226 is to provide a "fail-safe" function in the event that switch 215 for any reason fails to slow down the carriage and cause it to stop at the end of travel. The fail-safe switches 225 and 226 are in parallel with each other and are noramlly open. In the event they should close and if switch 215 has not functioned, the closing of either switch 225 or 226 will complete a circuit from DC source 227 to the integrated circuits. This will cause brake relay 221 to lose its voltage and cause the main drive motor to be braked, as discussed above relative to the main braking circuit actuated by switch 215.

On the main frame 9 of the machine, there is a panel stop switch 229 which can be used by an operator to stop the carriage at any part of its movement. The closing of switch 229 will short out the voltage source 227 to the integrated circuits and this will cause normally open contact 222 to close to thereby activate the brake resistor circuit containing brake resistor 224 to stop the main drive motor. Also mounted on frame 9 are switches 229 and 230 (FIG. 1). Switch 229 is activated by engaging block 231′ on cam 216. This will cause a reversal of electric motor 63 to thereby drive carriage 9 to the left in FIG. 1 after it has reached the end of its travel to the right. Switch 230 coacts with a block (not shown) which is analgous to block 231′ at the left end of the table to reverse the carriage driving motor at that point.

A plurality of other switches are associated with the electric circuit. First of all, there are the track wheel safety switches, such as 111 (FIGS. 14 and 35). Switch 111 is associated with guide wheel 92 and track wheel safety switch 111′ is associated in the same manner with guide wheel 93. Switches 111 and 111′ are normally closed to provide DC voltage from source 227 to the integrated circuits. When either one of these switches is opened, power is lost to the integrated circuits, and this will cause the transistor 220 to stop conducting, as described above. This in turn will cause the brake relay to lose its voltage and its normally opened contact 222 will close to cause the triac switch 223 to conduct to thereby place the dynamic brake resistor 224 across the main drive motor 63 and cause it to stop. It will be appreciated that the foregoing stopping will occur whenever either one of the guide wheels 92 or 93 leaves the track or for any reason, as explained in detail above, there is too great a variation in elevation between the track on which the guide wheel is run and the table. In the same circuit there is an out-of-cloth switch 142 (FIGS. 15 and 35) and a counter switch 232. The counter switch 232 is associated with the frame and will open when a predetermined amount of cloth has been played out of roll 24. Furthermore, the out-of-cloth switch 142 will open when the supply of cloth from roll 224 is exhausted, as sensed by the electric eye mechanism on the frame, as discussed above. When either switches 142 or 232 open, the main drive motor 63 will be caused to stop because of the interruption of the flow of current from DC source 227, as explained above relative to switches 111 and 111′.

While preferred embodiments of the present invention have been disclosed, it will be appreciated that the present invention is not limited thereto but may be otherwise embodied within the scope of the following claims.

What is claimed is:

1. A cloth-laying machine comprising first and second side frame members, cross frame means for joining said first and second side frame members, a plurality of driven wheels mounted on said first and second side frame members, drive means including motor means for positively driving each of said driven wheels, guide wheel means mounted relative to one of said side frame members for running on a track member, and switch means mounted proximate said guide wheel means for deenergizing said motor means in the event said guide wheel means moves a predetermined vertical amount relative to said one of said side frame members.

2. A cloth-laying machine as set forth in claim 1 wherein said guide wheel means comprise first and second guide wheels spaced lengthwise of the direction of travel of said cloth-laying machine.

3. A cloth-laying machine comprising first and second side frame members, cross frame means for joining said first and second side frame members, a plurality of driven wheels mounted on said first and second side frame members, drive means including motor means for positively driving each of said driven wheels, guide wheel means mounted relative to one of said side frame members for running on a track member, said guide wheel means comprising first and second guide wheels spaced lengthwise of the direction of travel of said cloth-laying machine, and switch means mounted proximate each of said first and second guide wheels for deenergizing said motor means in the event either one of said guide wheels moves a predetermined vertical amount relative to said one of said side frame members.

4. A cloth-laying machine comprising first and second side frame members, cross frame means for joining said first and second side frame members, a plurality of driven wheels mounted on said first and second side frame members, drive means including motor means for positively driving each of said driven wheels, guide wheel means mounted relative to one of said side frame members for running on a track member, a pair of driven load-bearing wheels mounted on each of said first and second side frame members, and spring means for biasing said guide wheel means toward said track member.

5. A cloth-laying machine as set forth in claim 4 wherein said guide wheel means is positioned proximate one of said driven wheels whereby said guide wheel means and said one of said driven wheels tend to move vertically in unison.

6. A cloth-laying machine comprising a frame, load bearing wheel means for supporting said frame on a cloth-laying table, motor means for driving said cloth-laying machine, guide wheel means mounted on said frame for engaging a track mounted relative to said table, spring biasing means for biasing said guide wheel means toward said track, and switch means mounted relative to said guide wheel means for deactivating said motor means in the event said guide wheel means experience a predetermined amount of vertical movement relative to said frame.

7. A cloth-laying machine as set forth in claim 6 wherein said guide wheel means comprise first and second guide wheels spaced longitudinally of the direction of movement of said frame.

8. A cloth-laying machine comprising a frame, load bearing wheel means for supporting said frame on a cloth-laying table, motor means for driving said cloth-laying machine, guide wheel means mounted on said frame for engaging a track mounted relative to said table, spring biasing means for biasing said guide wheel means toward said track, said guide wheel means comprising first and second guide wheels spaced longitudinally of the direction of movement of said frame, and first and second switch means mounted relative to said first and second guide wheels, respectively, for stopping said machine in the event either of said first and second guide wheel means experience a predetermined amount of vertical movement relative to said frame.

9. A cloth-laying machine as set forth in claim 8 wherein said frame includes a leading end and a trailing end and wherein one of said guide wheels is located proximate said leading end and wherein one of said guide wheels is located proximate said trailing end.

10. A cloth-laying machine comprising a frame, a plurality of wheel means for moving said frame on a cloth-laying table, motor means for driving said wheel means, brake means for stopping said machine, first means for actuating said brake means during normal operation, second means for actuating said brake means in the event said first means fail to function, guide wheel means for engaging a track, and switch means actuatable by said guide wheel means for stopping said machine in the event said guide wheel means moves a predetermined vertical amount relative to said frame.

* * * * *